US006776748B2

(12) United States Patent
Joux

(10) Patent No.: US 6,776,748 B2
(45) Date of Patent: Aug. 17, 2004

(54) DEVICE FOR BREAKING THE NICKS CONNECTING THE BLANKS OF A PILE OF CARDBOARD SHEETS

(75) Inventor: Gilbert Joux, Renens (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 10/455,586

(22) Filed: Jun. 4, 2003

(65) Prior Publication Data

US 2003/0224919 A1 Dec. 4, 2003

(30) Foreign Application Priority Data

Jun. 4, 2002 (CH) ..... 0933/02

(51) Int. Cl.[7] ..... B31B 1/64

(52) U.S. Cl. ..... 493/204; 493/340; 493/363; 493/373; 225/101; 225/104; 225/105

(58) Field of Search ..... 493/340, 342, 493/363, 373; 225/101, 100, 104, 105

(56) References Cited

U.S. PATENT DOCUMENTS 4,500,022 A * 2/1985 Lucas ..... 225/97
4,921,154 A * 5/1990 Abe et al. ..... 225/97
5,791,539 A * 8/1998 Shill et al. ..... 225/1
5,927,582 A * 7/1999 Duecker ..... 225/2
6,019,267 A * 2/2000 Shill et al. ..... 225/101
6,655,566 B1 * 12/2003 Martin et al. ..... 225/101

FOREIGN PATENT DOCUMENTS

CH 646665 12/1984
FR 2372025 6/1978

* cited by examiner

*Primary Examiner*—Stephen F. Gerrity
*Assistant Examiner*—Hemant M Desai
(74) *Attorney, Agent, or Firm*—Ostrolenk, Faber, Gerb & Soffen, LLP

(57) ABSTRACT

A stack of sheets, e.g. cardboard, with each sheet having lines of cut longitudinally and/or transversely. Apparatus for breaking the nicks connecting two edges of line of cut on the stacked sheets includes a first support and transport moving longitudinally and a first clamp thereabove for clamping the sheets, a first device for separating the clamped sheets along a transverse cut line. A second support and transport device moves the sheets thereat transversely until positioned so that the longitudinal line of cut is positioned so that the sheets may be clamped and the stacked sheets may be separated transversely along the longitudinal line of cut. A conveyor for shifting the sheet transversely to reposition the longitudinal line of cut for separation.

9 Claims, 6 Drawing Sheets

DEVICE FOR BREAKING THE NICKS CONNECTING THE BLANKS OF A PILE OF CARDBOARD SHEETS

BACKGROUND OF THE INVENTION

The present invention relates to a device for breaking the nicks connecting two edges of a line of cut of stacked sheets of cardboard placed on horizontal support and transportation means for moving the said sheets in a longitudinal direction, comprising upper claiming means for claiming the stacked sheets against the said support means, first means for longitudinally moving apart the said support and transportation means and the said clamping means on both sides of a transverse line of cut of the said stacked sheets, and second means for moving apart transversely the said support and clamping means on both sides of a longitudinal line of cut.

The devices of this type are used in particular during manufacture of cardboard boxes obtained by folding pre-cut and grooved cardboard blanks formed from sheets of cardboard.

Such devices for separating stacks of pre-cut sheets by clamping the stacks of sheets on both sides of the pre-cutting line and exerting traction to break the the nicks connecting these sheets exist. One of the them is described, for example in FR 2'372'025. However, this device is limited to the cutting of stacks of sheets on both sides of a transverse line. However, in most cases, in particular during manufacture of small packages a plurality of cardboard blanks are disposed side by side in the direction of both the length and the width of the cardboard sheet so that it is necessary to be able to separate the stacked sheets of cardboard not only in the transverse direction but also in the longitudinal direction of these sheets.

In CH 646'665 a device has already been proposed which permits separations to be carried out in two directions perpendicular to each other in the direction of the length of the cardboard sheets and in the transverse direction without needing to turn the sheets by 90° after a first cutting procedure. To this end this device has four support tables aligned two by two transversely and longitudinally with respect to the direction of movement of the stacks of cardboard sheets. These four tables are associated with four pressing members and can be moved apart from each other both longitudinally and transversely in order to effect separations between the stacks of sheets.

This device has certain drawbacks and limitations. These drawbacks include the fact that the separation along two lines perpendicular to each other is carried out by moving the tables and pressing members in a direction forming an angle of 45° with respect to the two lines of separation The force required is greater than it would be if it were directed perpendicular to each of the lines of separation. Consequently the stacks must be clamped more strongly and this poses a risk of marking the cardboard sheets which are at the extremities of the stacks.

The limitations of the device result from the fact that it does not permit a separation to be carried out transversely to the direction of movement of the sheets of cardboard. However, it is frequently the case that it is necessary to effect a greater number of separations especially when small packages, for cigarette packets or boxes for bottles of perfume for example, are being produced.

SUMMARY OF THE INVENTION

The aim of the present invention is to overcome at least partially the drawbacks of the above-mentioned solutions.

To this end the object of this invention is a device for breaking the the nicks connecting two edges of a line of cut of stacked sheets of cardboard placed on horizontal support and transportation means for moving the said sheets in a longitudinal direction.

The main advantage of this invention resides in the fact that it permits production of an unlimited number of cardboard blanks in the direction transverse to the main or longitudinal direction of movement of the stacks of sheets.

The transverse transportation means for the stacked sheets are preferably flexible elements, of which the two ends are attached to the supports of the longitudinal conveyor and pass over the transverse supports after having been passed around two sheaves fixed to the ends of these transverse supports.

For this reason, when the supports of the longitudinal conveyor are moved laterally in one direction, the part of the flexible element passing over the transverse supports moves in the opposite direction. By reason of these movements in opposite directions the length of the transverse movement of the supports of the longitudinal conveyor is added to that of the movement of the stacked sheets so that the relative displacement for bringing the lines of separation of the stacked sheets between the two supports of the longitudinal conveyor in order to separate them is twice as great as the actual displacement of each one of them. This permits a reduction in the width of the device for breaking the the nicks between the stacked sheets with respect to a system in which the support of the longitudinal conveyor would be fixed in the lateral direction, or a system in which the stacked sheets would be fixed in the lateral direction.

Other features and advantages of the device which is the object of the present invention will become clear during the following description which will be given with the aid of the attached drawings which illustrate schematically and by way of example an embodiment of the device for breaking the nicks connecting two edges of a line of cut of stacked sheets of cardboard.

DESCRIPTION OF A PREFERRED EMBODIMENT

Figure 1:
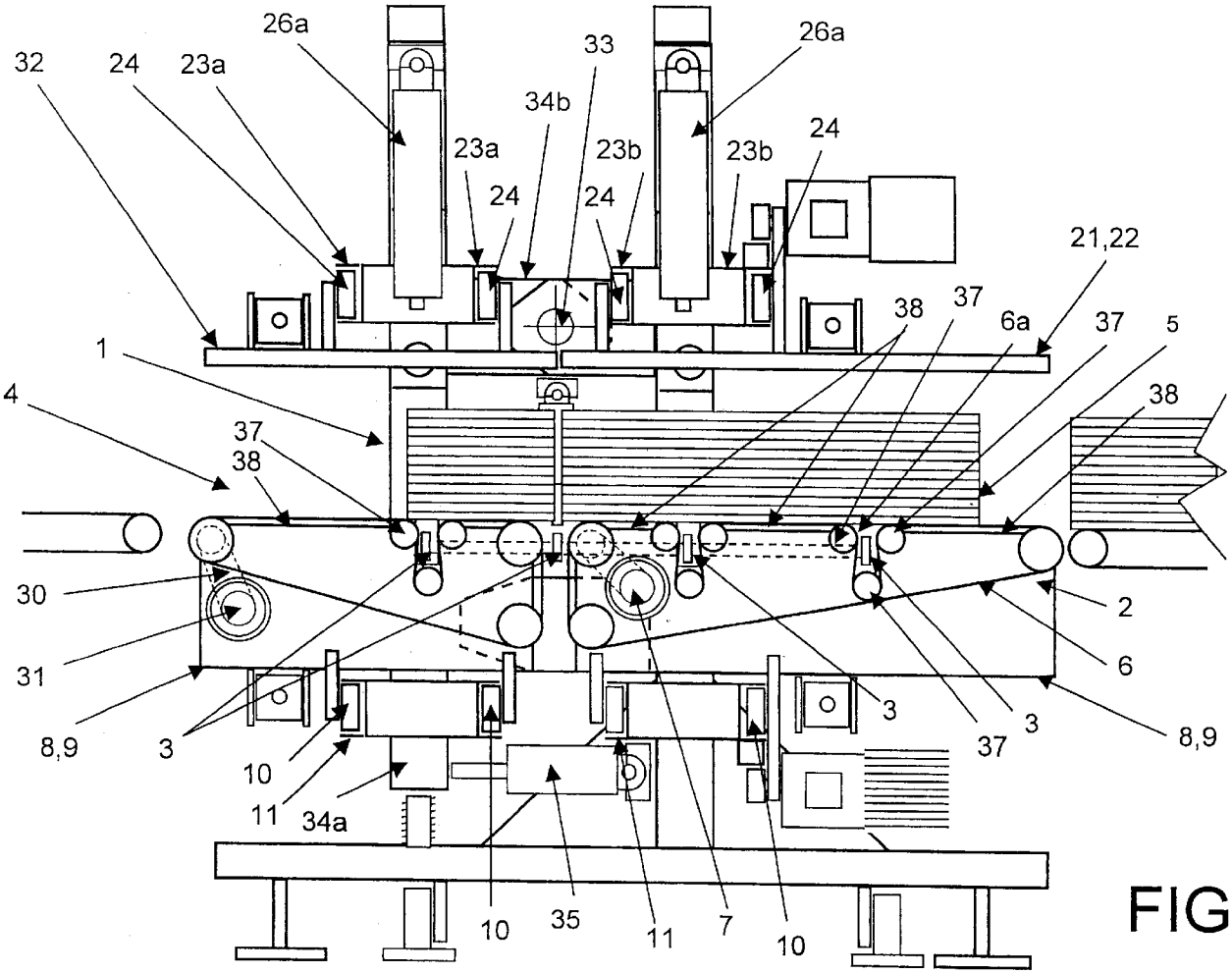
FIG. 1 is a lateral elevational view of this embodiment.
Figure 2:
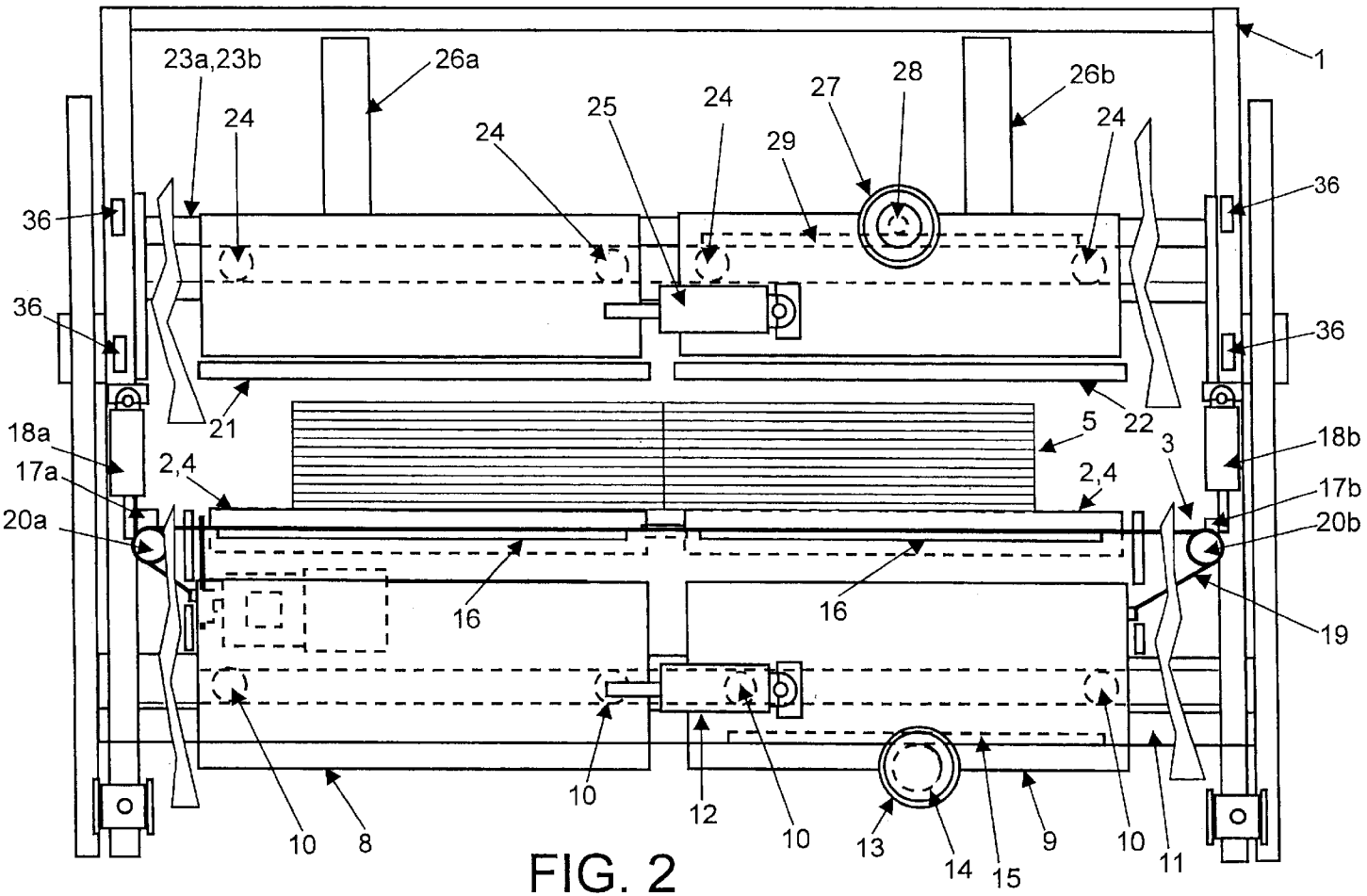
FIG. 2 is a transverse cross-sectional view of FIG. 1.

The device illustrated by FIGS. 1 and 2 has a frame 1 on which are mounted endless belt conveyors 2, 3, and 4. The conveyors 3 are disposed side by side in the transverse direction with respect to the direction of movement of the stacked sheets 5 as shown by FIG. 1. The conveyor 4 extends over the whole width of the conveyors 3, downstream of the conveyor 2.

The conveyor 2 has an endless conveyor belt 6 shown in FIG. 1 which is driven by a motor 7. The conveyors 2, 4 each also have a support chassis 8 and 9 respectively, which is mounted so as to slide by means of rollers 10 in engagement with a transverse guide and support rail 11 fixedly attached to the frame 1. These two support chassis 8, 9 are connected to each other transversely by means of a jack 12 (see FIG. 2). A motor 13 fixedly attached to the support chassis 8 drives a wheel 14 in engagement with a rack 15 fixedly attached to the transverse rail 11 thus permitting the two support chassis 8, 9 to be moved along this transverse rail 11.

As shown by FIG. 1 the horizontal parts of the conveyor belts 6 of the conveyors 2, 4 forming the support and transportation part of the stacked sheets 5 are guided by a series of rollers 37 disposed so as to create a succession of open loops 6*a* which extend below the upper support surface of the chassis 8, 9 and these chassis are also formed to leave the spaces inside these open loops 6*a* free. Support members 16 and transverse transportation members 3 for the stacked sheets 5 are housed in these loops 6*a*. The horizontal portions of the conveyor belts 6 which extend between the guide rollers 37 rest on support surfaces 38 fixedly attached to the chassis 8, 9 of the conveyors 2, 4. By means of this arrangement the abutment surfaces of the stacked sheets 5 is higher than that provided by rollers alone, which makes it possible to reduce the risk of marking the sheets of cardboard as a result of clamping the stacks 5.

These support members 16 and transverse transportation members 3 are in the form of elongate plates which extend over the whole width of the conveyors 3 disposed side by side and the two ends of these conveyors 3 are fixedly attached to two supports 17*a*, 17*b* which are connected to jacks 18*a*, 18*b*, of which only two are visible in FIG. 2. Each plate or support member 16 is shaped to guide a flexible transportation element 19 formed, in this example, by a belt segment with a circular cross-section, of which the two ends are fixed respectively to the chassis 8 and 9 after this belt has been passed around two sheaves 20*a*, 20*b*, fixedly attached to the supports 17*a* and 17*b* respectively.

By means of this arrangement the upper part of the belts forming the flexible transportation elements 19 is driven by the chassis 8, 9 which are moved by the action of the motor 13 and the wheel 14 in engagement the rack 15 in the opposite direction of movement of these chassis 8, 9. In this way the relative displacement between the stacked sheets 5 and the chassis 8, 9 which support them is double the actual displacement of these chassis 8, 9 and of the flexible transportation elements 19.

This multiplication by two between the length of the actual displacement and that of the relative displacement permits the length of the device in accordance with the invention to be substantially reduced. Thus in one practical embodiment where maximum travel of 160 cm is required, the actual displacement is only 80 cm so that the width of the device is reduced by 80 cm.

The upper part of the device is practically symmetrical with respect to the lower part which has just been described. It has two clamping members 21, 22 disposed on both sides in the transverse direction of the device, as shown by FIG. 2, and connected by a jack 25. The dimensions of these clamping members 21, 22 preferably correspond respectively with those of the chassis 8, 9 so as to permit them to press the stacked sheets 5 against these chassis 8, 9.

To this end these clamping members 21, 22 are mounted so as to slide by means of rollers 24 on two transverse rails 23*a*, 23*b* mounted respectively on two opposite sides of the frame 1. Each transverse rail 23*a*, 23*b* is itself mounted so as to slide vertically and is controlled by two jacks 26*a*, 26*b*.

In the same way as the chassis 8, 9, the clamping members 21, 22 are fixedly attached to a motor 27 which drives a toothed wheel 28 in engagement with racks 29 fixedly attached respectively to the transverse rails 23*a*, 23*b*. The motors 13 and 27 are controlled with respect to each other so that each movement of the chassis 8, 9 corresponds to a movement of the same magnitude and direction of the clamping members 21, 22.

The conveyor 4 located at the output of the conveyors 2 also has an endless conveyor belt 30 extending over the whole width of the conveyors 2, 3. This conveyor belt 30 is driven by a motor 31. This conveyor 4 also has a clamping member 32. The whole assembly is fixedly attached to a chassis 34*a*, 34*b* articulated about a transverse axis 33 fixedly attached to the guide rail 23*a*. A jack 35 serves to cause the chassis 34*a*, 34*b* to pivot about the transverse axis 33.

In order to permit movement of the clamping member 32 with respect to the upper horizontal part of the conveyor belt 30, the chassis 34*a*, 34*b* is formed from two parts, a lower part 34*a*, carrying the conveyor 4, and an upper part 34*b* carrying the clamping member 32. The lower part 34*a* has, on each side of the conveyor 4, four guide rollers 36 defining a vertical slide, between which guide rollers the upper part 34*b* is mounted in a sliding manner, permitting on the one hand this upper part 34*b* to slide with respect to the lower part 34*a* when the clamping member 32 is to clamp stacked sheets 5 against the conveyor belt 30 and on the other hand permitting the lower and upper parts of the frame 34*a*, 34*b* to tilt about the transverse axis 33 under the action of the jack 35.

The operation of the device just described will now be explained with the aid of FIGS. 1 and 2. With respect to the various possibilities offered by the mechanism described in detail with reference to FIGS. 1 and 2, these will be explained with the aid of the simplified diagrams of FIGS. 3 to 6, it being understood that it is still possible to refer to FIGS. 1 and 2 for details of how the device is constructed.

Figure 3:
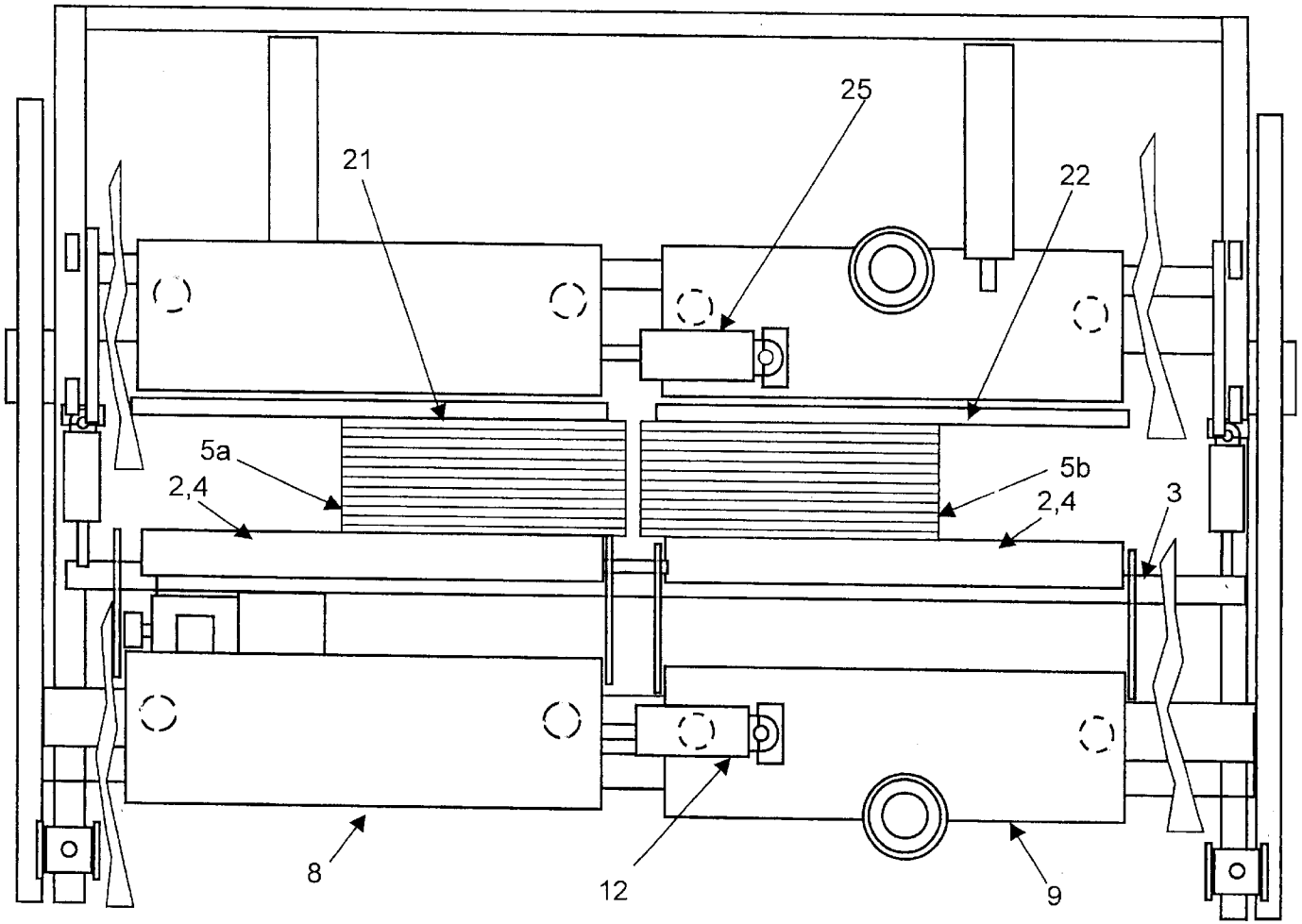
FIG. 3 is a block diagram of FIG. 2 showing the breakage of the nicks extending in an essentially longitudinal line in the direction of travel of the stacked sheets.

When a stack of pre-cut sheets 5 to be separated is brought onto the conveyors 2 and 3, these conveyors are located in the position illustrated by FIG. 2, centered in the direction of the width of the frame 1. If the stack 5 must be first separated into two equal parts in the width direction it merely has to be clamped between the conveyors 2, 4 and the clamping members 21, 22 using the four jacks 26*a*, 26*b*. Once a suitable clamping force is exerted the jacks 12 and 25 are actuated to move apart the chassis 8 and 9 of the conveyors 2, 4 and the clamping members 21 and 22. The force thus exerted on the stack 5 makes it possible to break the nicks left when the stacked sheets of card are pre-cut, as shown in FIG. 3.

When each half of the stack 5*a*, 5*b* must itself be subdivided into two or more parts then the procedure will be as follows. Firstly the clamping members 21, 22 are raised by means of the jacks 26*a*, 26*b*. Then the plates 16 fixedly attached to the support bars 17*a*, 17*b* are raised using the jacks 18*a*, 18*b* (FIG. 2) so as to separate the stacks 5*a*, 5*b* from the longitudinal conveyors 2, 4. The stacks 5*a*, 5*b* then rest on the conveyors belts 19 supported by the plates 16.

The chassis 8, 9 are then moved by means of the motor 13 and of the wheel 14 in engagement with the rack 15, as well as the clamping members 21, 22 using the motor 27 and the wheel 28 in engagement with the rack 29. These two movements are in the same direction and cover the same length. This length corresponds to half the transverse distance between the line of cut along which the stack 5 has just been separated and the line of cut along which the following separation must take place. In fact, given that the ends of the conveyor belts 19 are fixedly attached to the chassis 8, 9 and pass over the sheaves 20*a,* 20*b,* the movement of the chassis 8, 9 in one direction causes the oppositely-directed movement of the upper parts of the belts 19 on which the stacks 5*a,* 5*b* rest so that these stacks move in the opposite direction from the chassis 8, 9. For this reason the relative transverse displacement between the stacks 5*a,* 5*b* and the chassis 8, 9 is two times greater that the actual displacement of each one of them.

Figure 4:
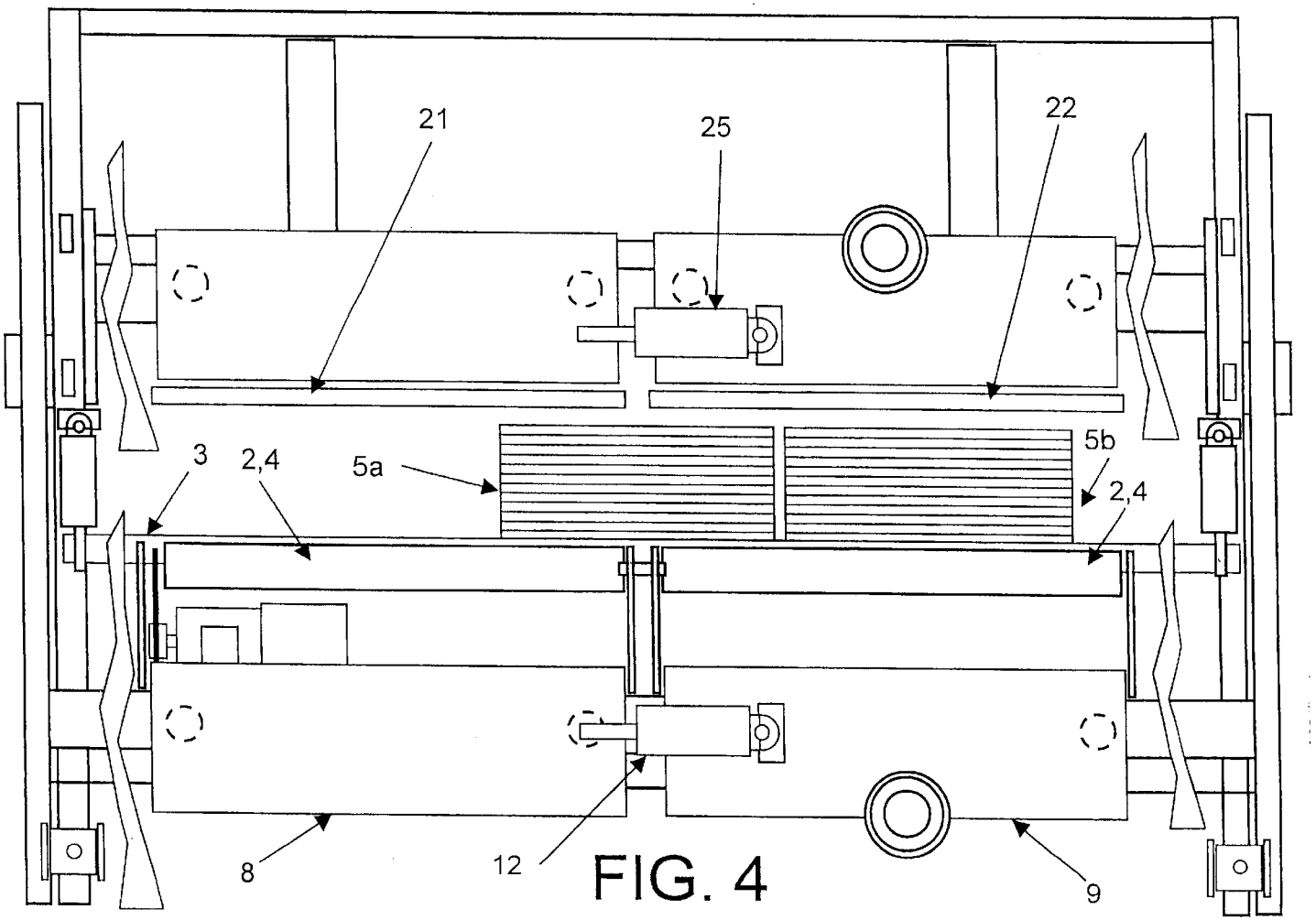
FIG. 4 is a view similar to FIG. 3 showing the movement of the stacked sheets transversely to the direction of travel of the stacked sheets.
Figure 5:
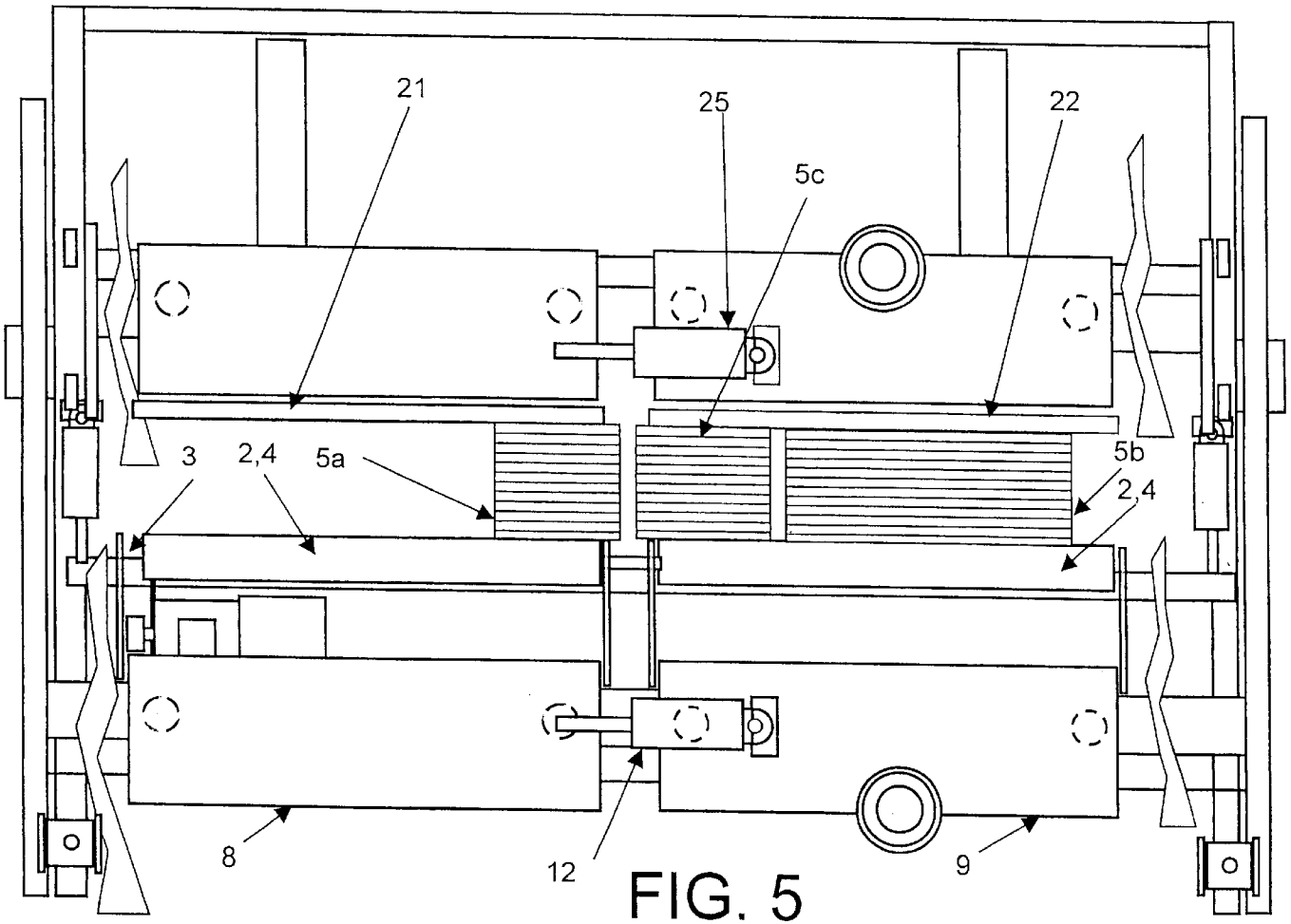
FIG. 5 is a view similar to FIG. 3 showing the breakage of the nicks in a line essentially parallel to that of FIG. 3.
Figure 6:
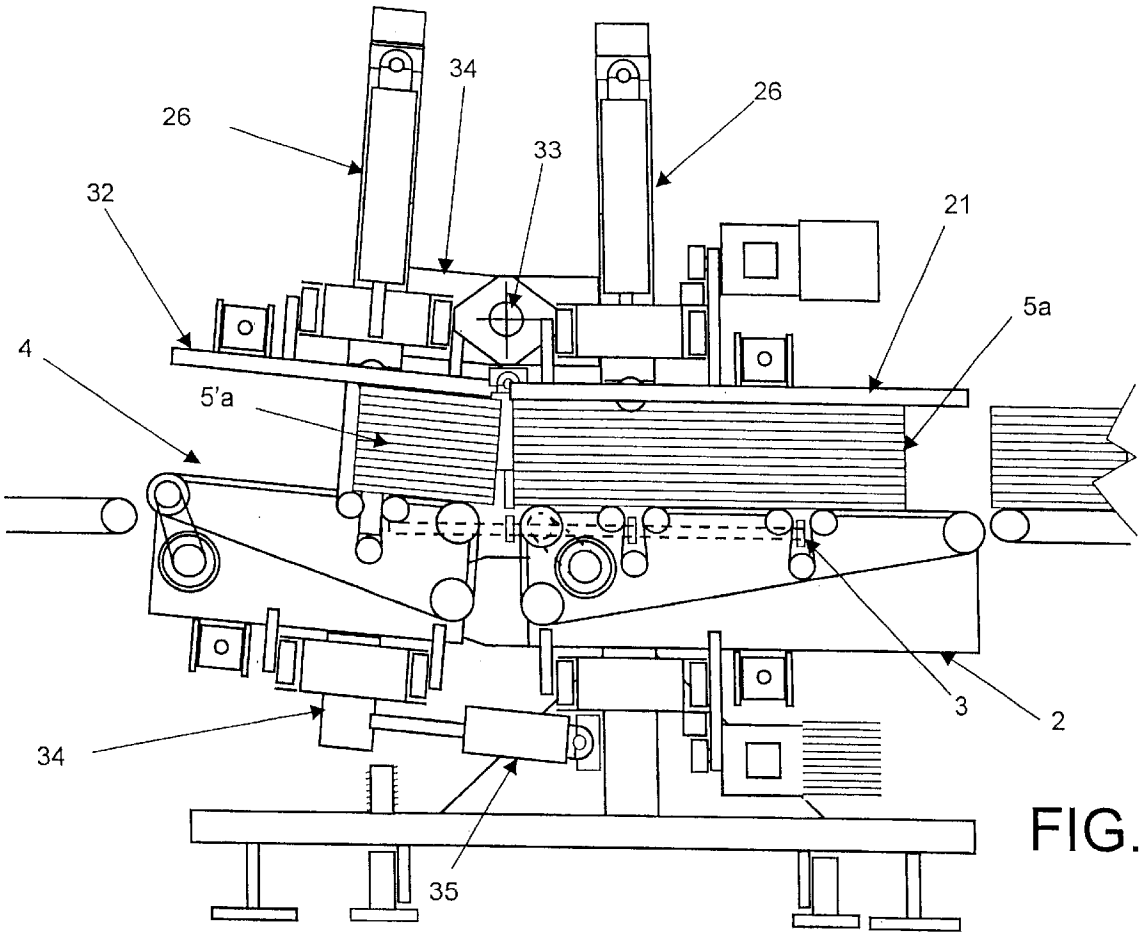
FIG. 6 is a functional diagram of the arrangement of FIG. 1 showing the breakage of the nicks extending along a line essentially transverse to the direction of travel of the stacked sheets.

This position is, for example, the position illustrated by FIG. 4. A new separation of the stack 5*a* can then be carried out as described above, the stack 5*b* then not being separated, as shown by FIG. 5.

Other separations are possible. In the case illustrated the stack 5*b* could then also be separated into two. The chassis 8, 9 would then merely have to be moved in the opposite direction to bring the middle of the stack 5*b* between the two chassis 8, 9 and between the two clamping members 21, 22. By means of this device it is possible to produce small stacks of boxes from a stack of wide sheets since the stack will then merely have to be divided into as many smaller stacks as there are lines of cut in the width of the initial sheet.

In order to divide the stacks thus formed along the lines of cut which are essentially transverse to the longitudinal direction of travel of the stacks 5*a,* 5*b,* 5*c,* 5*d* . . . these stacks will then merely have to be advanced in order to bring a line of cut between the longitudinal conveyors 2, 4 and the transverse conveyor 3. Then as in the previous case the procedure continues with the clamping members 21, 22 and 32 being lowered using the jacks 26*a,* 26*b.* The jack 35 is then actuated to cause the chassis 34*a,* 34*b* to pivot about the axis 33 in order to bring it into the position illustrated in FIG. 6 and thus cause the breakage of the the nicks to form a new stack 5'*a* at the output of stack 5*a*. At the same time the stacks 5'*b*, 5'*c*, 5'*d*, not shown, are formed. The following separations are obtained by bringing the conveyor 4 into a horizontal position by causing the spindle of the jack 35 to be retracted into its piston and by raising the clamping members 21, 22, 32 then removing the stacks 5'*a*, 5'*b*, 5'*c*, 5'*d* and advancing the remaining stacks located on the conveyors 2, 4 as far as the next line of cut and recommencing the same operation.

What is claimed is:

1. Apparatus for breaking nicks that connect a longitudinal line of cut and a transverse line of cut in each sheet of a stack of sheets of material, the apparatus comprising:

a longitudinal transport device supporting the sheets and for moving the sheets in a longitudinal direction, the longitudinal transport device comprising a longitudinal support below the stack and an upper clamp above the stack for clamping the stack of sheets against the longitudinal support;

a first separating device for longitudinally separating both the longitudinal support and the upper clamp in the longitudinal direction at both opposite sides of a transverse line of cut of the stacked sheets when the longitudinal transport device has moved the sheets so that the transverse line of cut is at a location of longitudinal separation;

both the longitudinal support and the upper clamp include a first respective part thereof which is movable transversely of the longitudinal direction with respect to a second respective part thereof;

a transverse movement device for moving transversely apart the first and second parts of the longitudinal support and of the upper clamp at both sides of a location of transverse separation along a longitudinal line of cut in the stacked sheets when the longitudinal line of cut is placed at the transverse location of separation of the first and second parts of the longitudinal support and the upper clamp;

the transverse movement device including a transverse transport device at the sheets for moving the stacked sheets in a direction transversely of the longitudinal direction to enable positioning of the stacked sheets with the longitudinal line of cut at the transverse location of separation.

2. The apparatus of claim 1, further comprising a vertical motion device connected with the transverse movement device and operable for moving the transverse movement device vertically between a lower position at which the transverse movement device is at a lower level than the longitudinal transport device and an upraised position at which the transverse movement device is at a higher level than the longitudinal transport device;

the transverse movement device being operable for setting the transverse location of separation where the first and second parts of the longitudinal transport device separate from each other with respect to the longitudinal line of cut in the stack of sheets.

3. The apparatus of claim 2, wherein the transverse movement device has a longitudinal length and comprises a flexible element sized and shaped to extend over the longitudinal length of the transverse movement device;

the transverse movement device having lateral ends; sheaves at the lateral ends of the transverse movement device about which the flexible element passes; the flexible element having ends which are attached to the longitudinal transport device such that upon motion of the longitudinal transport device transversely in a direction, a part of the flexible element extending over the transverse movement device moves transversely in an opposite direction.

4. The device of claim 1, further comprising:

the transverse movement device being operable for setting the transverse location of separation where the first and second parts of the longitudinal transport device separate from each other with respect to the longitudinal line of cut in the stack of sheets;

the transverse movement device has a longitudinal length and comprises a flexible element sized and shaped to extend over the longitudinal length of the transverse movement device;

the transverse movement device has a longitudinal length and having lateral ends; sheaves at the lateral ends of the second transverse movement device about which the flexible element passes; the flexible element having ends which are attached to the longitudinal transport device such that upon motion of the longitudinal transport device transversely in a direction, a part of the flexible element extending over the transverse movement device moves transversely in an opposite direction.

5. The apparatus of claim 1, further comprising;

the transverse movement device being operable for setting the transverse location of separation where the first and second parts of the longitudinal transport device separate from each other with respect to the longitudinal line of cut in the stack of sheets;

the longitudinal transport device comprising at least two endless conveyor belts oriented and operated for conveying stacked sheets in the longitudinal direction and the belts being located on both sides of the transverse location of separation.

6. The apparatus of claim 5, further comprising supports for the at least two conveyor belts and which define a path for the belts, each conveyor belt having an upper part extending over the longitudinal transport device and forming the conveyor belts into open loops which loop below the level of the longitudinal transport device.

7. The apparatus of claim 6, wherein the transverse movement device is disposed in the open loop of the conveyor belt.

8. The apparatus of claim 6, further comprising planar abutment surfaces attached to the longitudinal transport device; and the conveyor belts include horizontal portions between the loops thereof which rest on the planar abutment surfaces.

9. The apparatus of claim 1, further comprising two of the longitudinal transport devices and two of the cooperating upper clamps disposed side by side on both sides of the longitudinal line of cut;

a second longitudinal transport device and a respective cooperating second upper clamp cooperating for clamping a stack of sheets between them, and the second longitudinal transport device and the cooperating second upper clamp extending transversely over the width of the longitudinal transport device at least sufficiently to extend over the longitudinal line of cut, the second longitudinal transport device being downstream in the longitudinal direction from the longitudinal transport device for further moving the sheets in the longitudinal direction;

the separation of the longitudinal and transport device along a transverse line of cut of the stacked sheets is comprised of moving the second longitudinal transport device and the respective second clamp longitudinally away from the longitudinal transport device for separating the stacked sheets along a transverse cut line between the transport devices; and a longitudinal separation device for separating the longitudinal transport device and the second longitudinal transport device.

* * * * *